United States Patent [19]

Scarcello et al.

[11] Patent Number: 4,866,863

[45] Date of Patent: Sep. 19, 1989

[54] EMPTY TOMB

[76] Inventors: Carolyn D. Scarcello, 858 Sherman Ave., Thornwood, N.Y. 10594; George Spector, 233 Broadway Rm 3815, New York, N.Y. 10007

[21] Appl. No.: 167,042

[22] Filed: Mar. 11, 1988

[51] Int. Cl.[4] ..... G09F 19/00

[52] U.S. Cl. ..... 40/124.5; 428/3

[58] Field of Search ..... 40/124.5; 428/3; 273/8 D; D99/25; 434/378, 245

[56] References Cited

U.S. PATENT DOCUMENTS

| | | | |
|---|---|---|---|
| 1,794,109 | 2/1931 | Eckert | 428/3 |
| 2,310,738 | 2/1943 | Johnston | 428/3 |
| 2,821,621 | 1/1958 | Allunario | 428/3 |

*Primary Examiner*—Robert P. Swiatek
*Assistant Examiner*—Cary E. Stone

[57] ABSTRACT

A religious shrine is provided that is a miniature replica of the Garden Tomb in Jerusalem as described in the New Testament of the bible. In a modification the top cover of the shrine can be raised by a mechanism activated by rolling the round stone at the entrance into an open position.

4 Claims, 1 Drawing Sheet

EMPTY TOMB

BACKGROUND OF THE INVENTION

The instant invention relates generally to ornamental devices and more specifically it relates to a religious shrine.

Numerous ornamental devices have been provided in prior art that are adapted to display biblical subjects. For example, U.S. Pat. Nos. 2,286,127, 2,821,621 and 3,349,661 all are illustrative of such prior art. While these units may be suitable for the particular purpose to which they address, they would not be as suitable for the purposes of the present invention as heretofore described.

SUMMARY OF THE INVENTION

A primary object of the present invention is to provide a religious shrine that will overcome the shortcomings of the prior art devices.

Another object is to provide a religious shrine that is a miniature replica of the Garden Tomb in Jerusalem as described in the New Testament of the bible.

An additional object is to provide a religious shrine in which the top cover of the shrine can be raised by a mechanism activated by rolling the round stone into an open position.

A further object is to provide a religious shrine that is simple and easy to use.

A still further object is to provide a religious shrine that is economical in cost to manufacture.

Further objects of the invention will appear as the description proceeds.

To the accomplishment of the above and relate objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
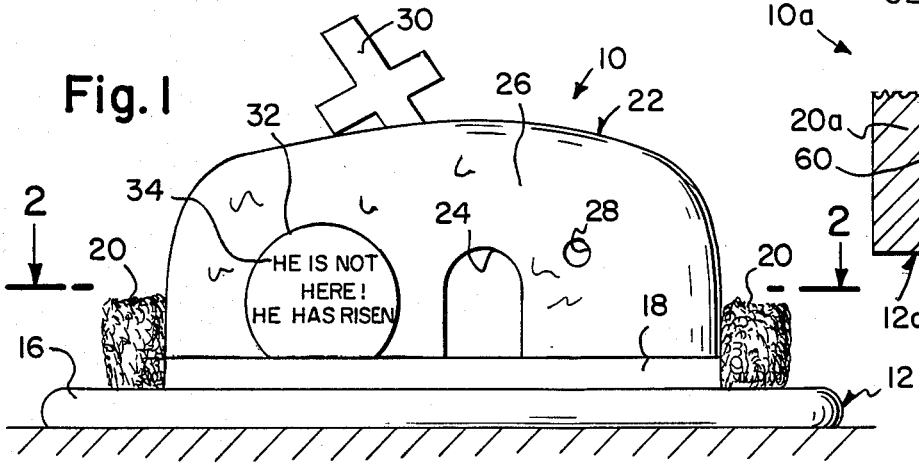
FIG. 1 is a front view of the invention.
Figure 2:
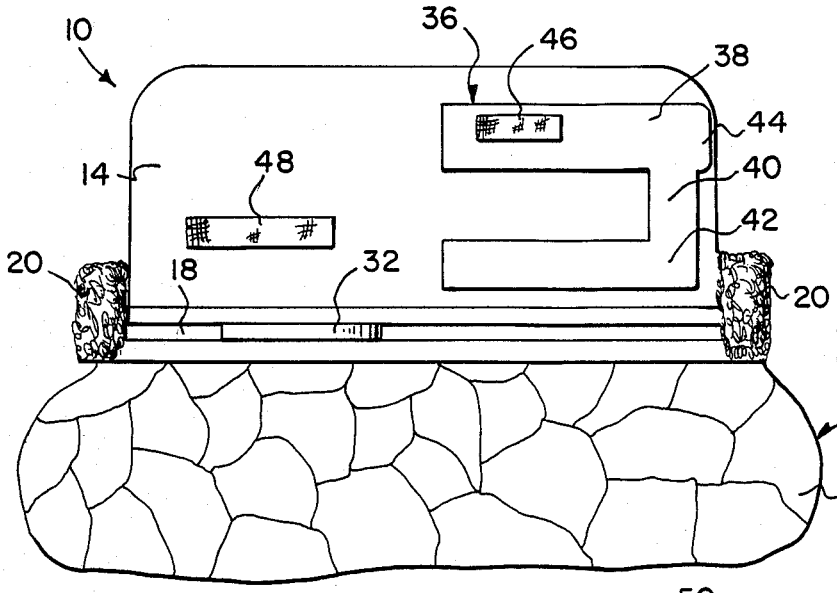
FIG. 2 is a top view as taken along line 2—2 in FIG. 1 with the top cover removed.

Turning now descriptively to the drawings, in which similar reference characters denote similar elements throughout the several views, FIGS. 1 and 2 illustrate a religious shrine 10 being a miniature replica of Garden Tomb in Jerusalem. The shrine 10 consists of a base 12 that has a mourning chamber 14 with a stone patio 16 in front, a grooved track 18 therebetween extending across width of the base 12 and bushes 20 on each side of the grooved track 18 to act as stops. A bowl shaped top cover 22 is sized to fit over the mourning chamber 14. The top cover 22 has an entrance 24 in front wall 26 representing a doorway and an opening 28 in the front wall 26 adjacent the entrance 24 representing a window. A tilted cross 30 is affixed to rear wall of the top cover 22. A round stone 32 has indicia 34, being "HE IS NOT HERE!. HE IS RISEN" thereon, is vertically placed within the grooved track 18 in the base 12 so as to be manually rolled to close and open the entrance 24 of the top cover 22.

The top cove 22 is movable from the mourning chamber 14 so as to allow viewing within the mourning chamber. A generally C-shaped configuration 36 is formed on right side of the mourning chamber 14 representing a first body bench 38, alter bench 40 and second body bench 42. The first body bench 38 is longer than the second body bench 42 by having an extended portion 44 at side adjacent the alter bench 40. A head cloth 46 is disposed on the first body bench 38 while a shroud 48 is disposed on left side of the mourning chamber 14.

Figure 3:
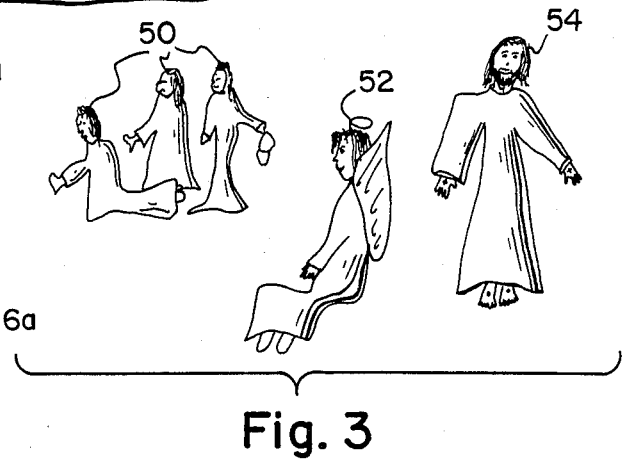
FIG. 3 are elevational views of the three ladies with spices, the sitting angle and the risen Christ figurines used in conjunction with the invention.

FIG. 3 shows three figurines 50 representing three women with spices, a fourth figurine 52 representing a sitting angel and a fifth figurine 54 representing a risen Jesus Christ, whereby the figurines are disposed thereabout the shrine 10 to present a biblical scenic display.

Figure 5:
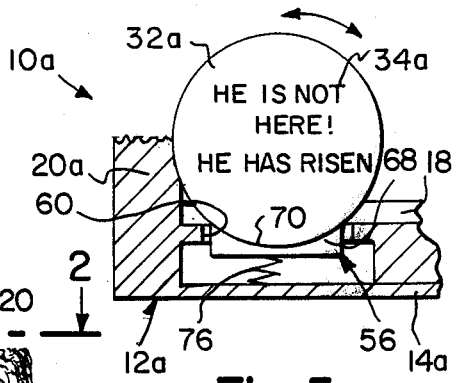
FIG. 5 is a cross sectional view taken along line 5—5 in FIG. 4.
Figure 4:
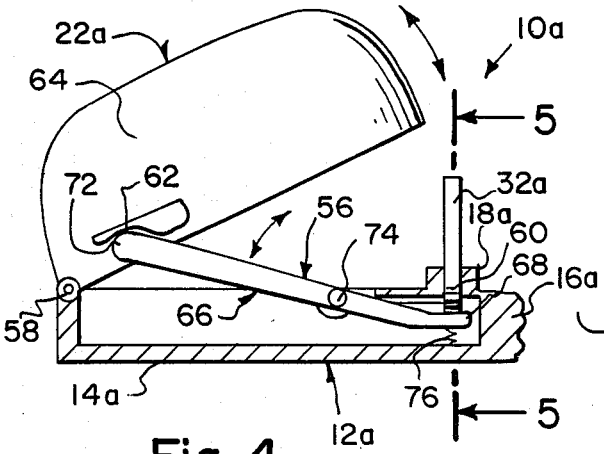
FIG. 4 is a side view partly in section with parts broken away showing a mechanism activated by the round stone for raising the top cover.

FIGS. 4 and 5 show a modified religious shrine **10*a* in which a mechanism 56 is provided to open the top cover 22*a* when activated by rolling the round stone 32*a* into an open position. The mechanism 56 includes a hinge 58 on rear edge of the mourning chamber 14*a* of the base 12*a* and bottom rear edge of the top cover 22*a* so that the top cover can pivot up from the front of the mourning chamber 14*a*. The grooved track 18*a* in the base 12*a* has a bottom aperture 60 located on left side thereof. A cam 62 is disposed on left side wall 64 of the top cover 22*a*. An arm 66 is provided with a lever portion 68 on one end that has a concave top surface 70 and a follower portion 72 on other end. The arm 66 is pivotly mounted at 74 within left side of the mourning chamber 14*a* of the base 12*a* transverse to the grooved track 18*a*, with the lever portion 68 extending under and through the aperture 60 in the grooved track 18*a*. The concave top surface 70 can receive the round stone 32*a* while the follower portion 72 can engage with the cam 62 to pivotly open the top cover 22*a*. A spring 76 is located under the lever portion 68 of the arm 66 for returning the arm back to its original position when weight of the round stone 32*a* is removed from the lever portion 68 of the arm 66**.

Colors can be added to the shrines 10 and **10*a* such as brown/grey for the stone patios 16 and 16*a*, light yellow for the top covers 22 and 22*a* and mourning chambers 14 and 14*a*, green for the bushes 20 and 20*a* and blue/white or silver for the garments of the risen Christ figurine 54** to signify the glory of Easter.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A religious shrine being a miniature replica of Garden Tomb in Jerusalem, said shrine comprising:

(a) a base having a mourning chamber with a stone patio in front, a grooved track therebetween extending across width of said base and bushes on each side of the grooved track to act as stops;

(b) a bowl shaped top cover sized to fit over the mourning chamber of said base, said top cover having an entrance in a front wall thereof representing a doorway and an opening in the front wall adjacent the entrance representing a window;

(c) a tilted cross affixed to rear wall of said top cover; and (d) a round stone having indicia thereon, vertically placed within the grooved track in said base so as to be manually rolled to close and open the entrance of said top cover.

2. A religious shrine as recited in claim 1, further comprising:

(a) said top cover being movable from the mourning chamber so as to allow viewing within the mourning chamber;

(b) a generally C-shaped configuration formed on right side of the mourning chamber representing a first body bench, altar bench and second body bench, the first body bench being longer than the second body bench by having an extended portion at side adjacent the altar bench;

(c) a head cloth disposed on the first body bench; and (d) a shroud disposed on the left side of the mourning chamber.

3. A religious shrine as recited in claim 2, further comprising:

(a) three figurines representing three women with spices;

(b) a fourth figurine representing a sitting angel; and (c) a fifth figurine representing a risen Jesus Christ, whereby said figurines are disposed thereabout to present a biblical scenic display.

4. A religious shrine as recited in claim 3, further comprising a mechanism to open said top cover when activated by rolling said round stone into an open position, said mechanism including:

(a) a hinge on rear edge of the mourning chamber of said base and a bottom rear edge of said top cover so that said top cover can pivot up from the front of the mourning chamber;

(b) the grooved track in said base having a bottom aperture located on the left side thereof;

(c) a cam disposed on a left side wall of said top cover;

(d) an arm with a lever position on one end having a concave top surface and a follower portion on other end, said arm pivotly mounted within said left side of the mourning chamber of said base transverse to the grooved track, with the lever portion extending under and through the aperture in the grooved track so that the concave top surface can engage with said cam to pivotly open said top cover; and (e) a spring located under the lever portion of said arm for returning said arm back to its original position when weight of said round stone is removed from the lever portion of said arm.

* * * * *